US007866838B2

(12) United States Patent
Wang et al.

(10) Patent No.: US 7,866,838 B2
(45) Date of Patent: Jan. 11, 2011

(54) ILLUMINATING DEVICE WITH REMOTE CONTROL

(75) Inventors: Chun-Wei Wang, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 345 days.

(21) Appl. No.: 12/110,569

(22) Filed: Apr. 28, 2008

(65) Prior Publication Data

US 2009/0189528 A1 Jul. 30, 2009

(30) Foreign Application Priority Data

Jan. 25, 2008 (CN) ..... 2008 1 0300225

(51) Int. Cl.
*F21V 33/00* (2006.01)
*F21V 21/00* (2006.01)
*F21V 11/00* (2006.01)

(52) U.S. Cl. ..... 362/85; 362/249.02; 362/373

(58) Field of Classification Search ..... 315/32, 315/51; 362/84, 85, 227, 249.01–249.03, 362/257, 373

See application file for complete search history.

(56) References Cited

U.S. PATENT DOCUMENTS

| | | | | |
|---|---|---|---|---|
| 6,502,956 | B1 | 1/2003 | Wu | |
| 6,787,999 | B2 | 9/2004 | Stimac et al. | |
| 6,799,864 | B2 | 10/2004 | Bohler et al. | |
| 7,319,394 | B2 * | 1/2008 | Sheller | 340/572.1 |
| 7,604,370 | B2 * | 10/2009 | Dowdy et al. | 362/199 |

FOREIGN PATENT DOCUMENTS

CN 200958702 Y 10/2007

* cited by examiner

*Primary Examiner*—Thuy Vinh Tran
(74) *Attorney, Agent, or Firm*—Andrew C. Cheng

(57) ABSTRACT

An illuminating device (10) includes a light source module (11) and an electronic module (15) detachably connected with the light source module. The light source module includes a plurality of light emitting diodes (112). The electronic module includes a receiver (151), a control circuit (152) electronically coupled to the receiver, and a driver circuit (150) for driving the light emitting diodes. The receiver is used to receive a wireless control signal from a remote controller (19), and the control circuit is used to control the driver circuit according to the received control signal.

12 Claims, 7 Drawing Sheets

ILLUMINATING DEVICE WITH REMOTE CONTROL

BACKGROUND

1. Technical Field

The present invention relates generally to illuminating devices, and particularly to an illuminating device incorporating light emitting diodes (LEDs) for achieving remote control.

2. Description of Related Art

With the continuing development of scientific technology, LEDs have been widely used in illumination fields to substitute for conventional cold cathode fluorescent lamps (CCFL) due to their high brightness, long life-span, and wide color gamut. Relevant subject is disclosed in an article entitled "Solid-State Lighting: Toward Superior Illumination", published in a magazine Proceedings of the IEEE, Vol. 93, No. 10, by Michael S. Shur et al. in October, 2005, the disclosure of which is incorporated herein by reference.

The illuminating device incorporating LEDs can be more easily controlled by remote controllers.

What is needed, therefore, is an illuminating device, which can be controlled to turn on or turn off by a remote controller.

SUMMARY

According to an exemplary embodiment, the illuminating device includes a light source module and an electronic module detachably connected with the light source module. The light source module includes a plurality of light emitting diodes. The electronic module includes a receiver, a control circuit electronically coupled to the receiver, and a driver circuit for driving the light emitting diodes. The receiver is used to receive a wireless control signal from a remote controller, and the control circuit is used to control the driver circuit according to the received control signal.

Other advantages and novel features of the present invention will become more apparent from the following detailed description when taken in conjunction with the accompanying drawings:

BRIEF DESCRIPTION OF THE DRAWINGS

Many aspects of the present illuminating device can be better understood with reference to the following drawings. The components in the drawings are not necessarily drawn to scale, the emphasis instead being placed upon clearly illustrating the principles of the present illuminating device. Moreover, in the drawings, like reference numerals designate corresponding parts throughout the several views.

DETAILED DESCRIPTION

Figure 1:
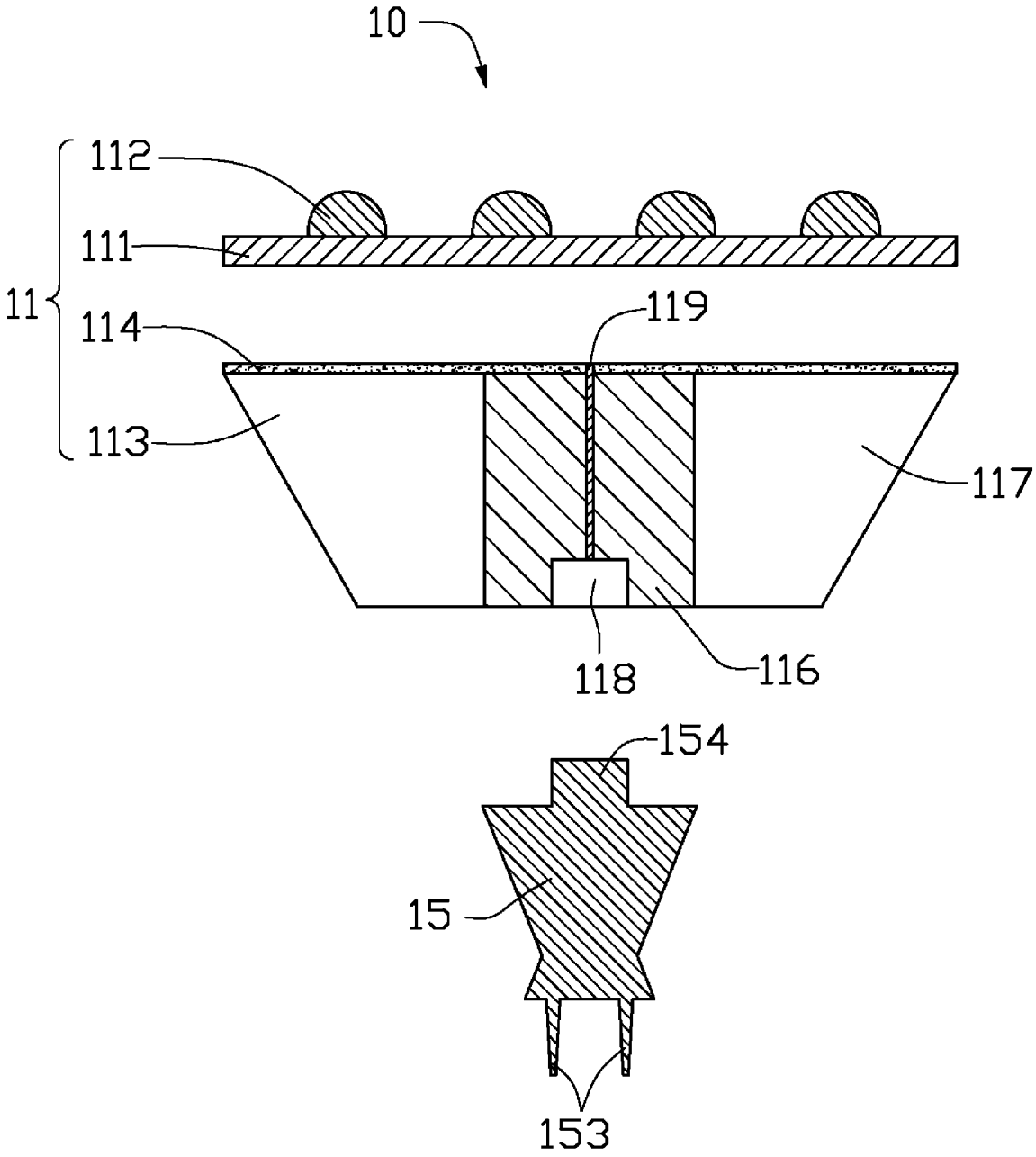
FIG. 1 is an exploded, cross-sectional view of an illuminating device, in accordance with a first embodiment of the present invention.
Figure 2:
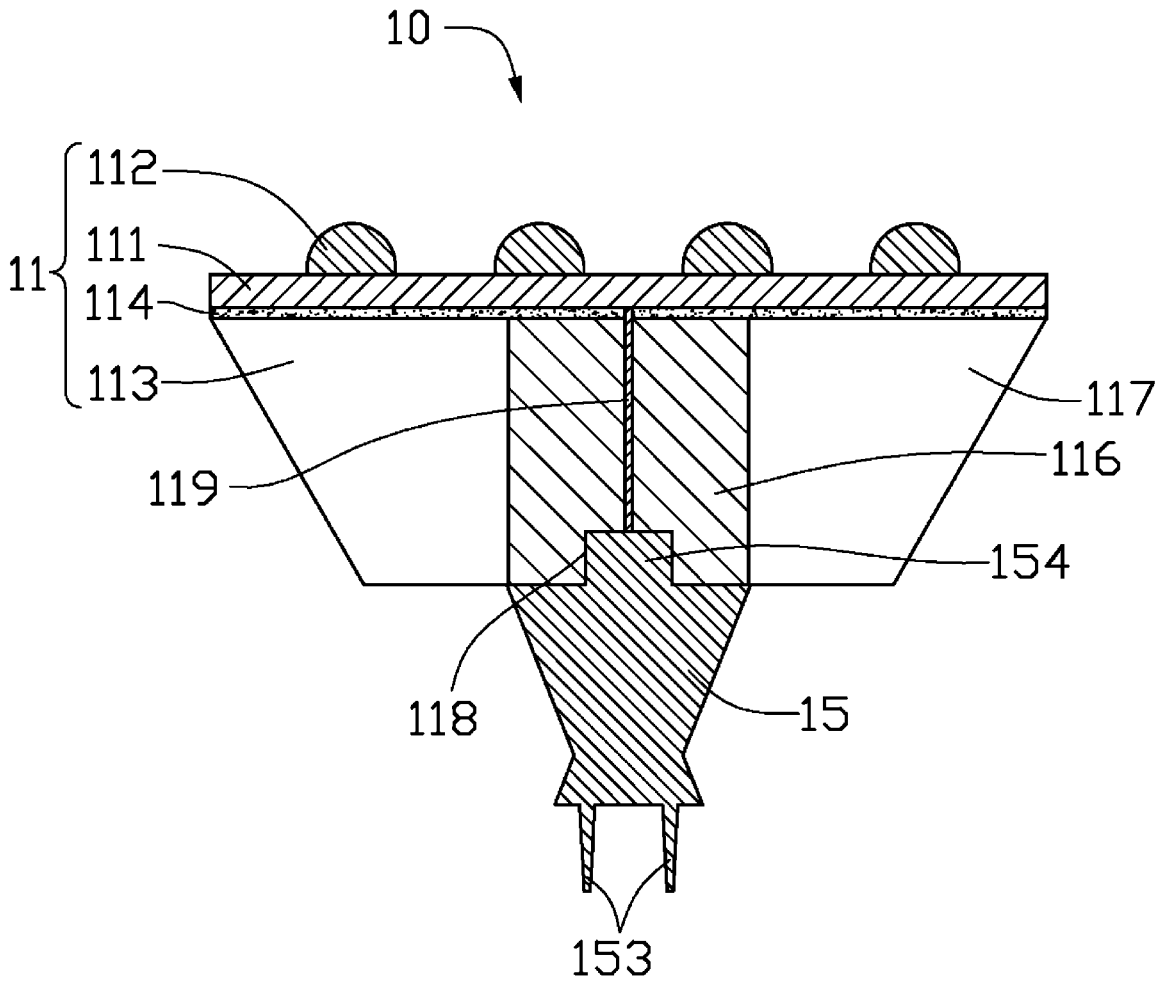
FIG. 2 is an assembled view of the illuminating device of FIG. 1.

Referring to FIGS. 1 and 2, an illuminating device 10 in accordance with a first embodiment of the present invention includes a light source module 11 and an electronic module 15 detachably engaged with the light source module 11.

The light source module 11 includes a printed circuit board (PCB) 111, a plurality of light emitting components mounted on the PCB 111, a heat sink 113 thermally connected with the PCB 111, and a thermal tape 114 interposed between the PCB 111 and the heat sink 113. In the present embodiment, the light emitting components are LEDs 112.

The PCB 111 is made of materials having good thermal conductivity, such as metal core printed circuit board (MCPCB) and so on. The LEDs 112 are evenly distributed on the PCB 111, and thermally and electrically connect with the PCB 111. The thermal tape 114 is used for transferring heat between the PCB 111 and the heat sink 113.

The heat sink 113 is used to dissipate heat generated from the LEDs 112. The heat sink 113 includes a heat conductive post 116 and a plurality of fins 117 radially and outwardly extending from the heat conductive post 116. The heat conductive post 116 is made of materials having good thermal conductivity, such as copper, aluminum and so on. A connecting groove 118 is defined at a bottom end of the heat conductive post 116 for engaging the light source module 11 with the electronic module 15. An electric wire 119 extends through the heat conductive post 116 and the thermal tape 114. One end of the electric wire 119 extends to the PCB 111, and the other end of the electric wire 119 extends to the connecting groove 118, for electrically interconnecting the PCB 111 with the electronic module 15.

A pair of electrical input connectors 153 and an output coupler 154 are respectively formed at a bottom end and a top end of the electronic module 15. The output coupler 154 is protruded out of the electronic module 15 to engage in the connecting groove 118 of the light source module 11. The output couple 154 mechanically connects the electronic module 15 with the heat sink 113 and electrically connects the electronic module 15 with the electric wire 119. In the present embodiment, the input connectors 153 are GU10-type connectors. Alternatively, the input connectors 153 can be other types of connectors, such as M16-type, E27-type and so on.

Figure 3:
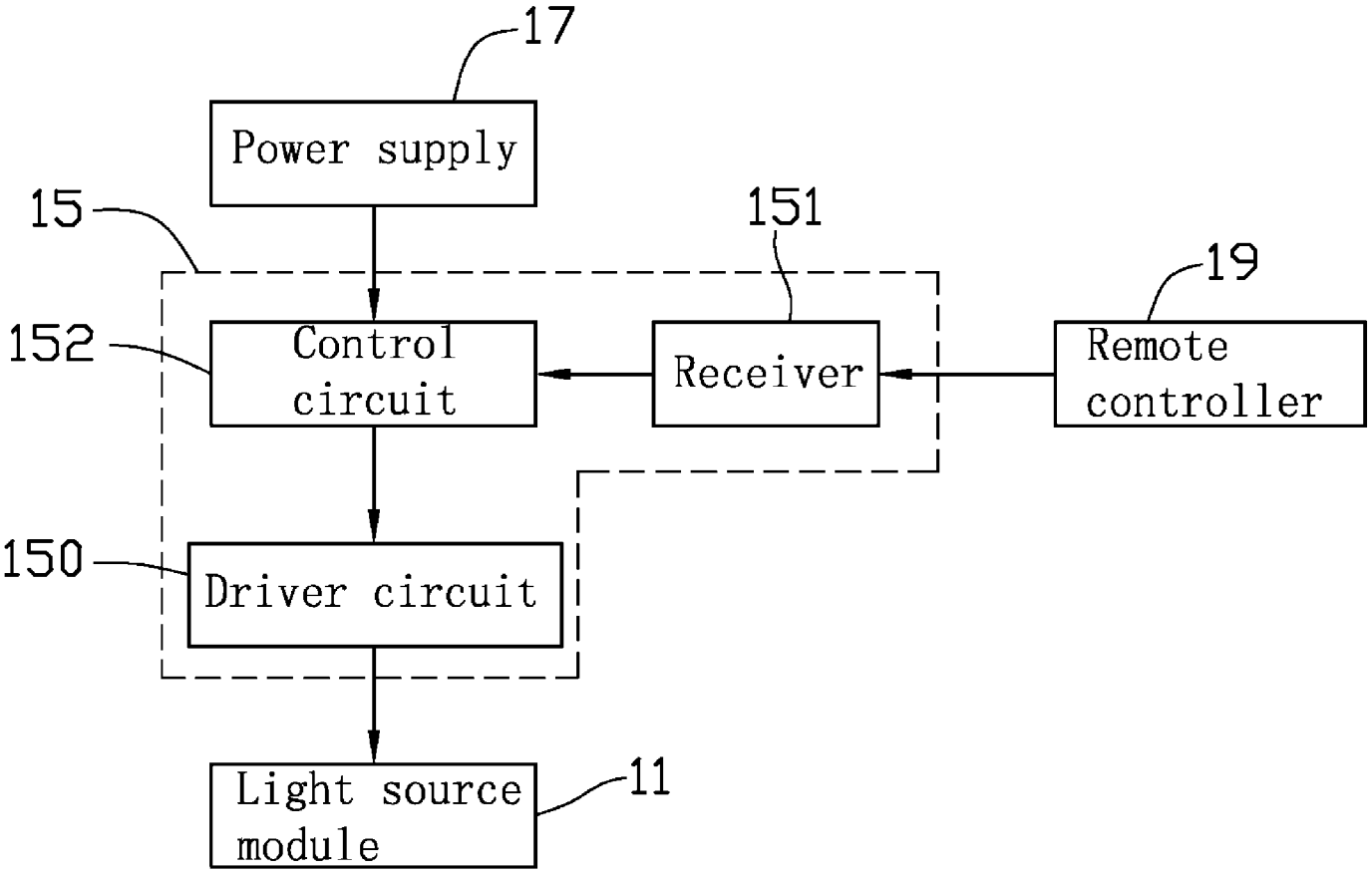
FIG. 3 is a diagram showing a working principle of the illuminating device of FIG. 1.

Referring to FIG. 3, the electronic module 15 includes a receiver 151, a control circuit 152 and a driver circuit 150. The receiver 151 is used to receives signals from a remote controller 19, and transmit the signals to the driver circuit 150 via the control circuit 152. The driver circuit 150 is used to drive the light source module 11 to operate. The input connectors 153 of the electronic module 15 are electrically connected with a selected power supply 17 for supplying power to the electronic module 15 and the light source module 11.

Referring to FIG. 3, during operation of the illuminating device 10, the power supply 17 supplies power to the electronic module 15 and the light source module 11. A command is inputted into the remote controller 19, and then the remote controller 19 sends out a wireless input signal. The receiver 151 of the electronic module 15 receives the wireless input signal, and then transmits the wireless input signal to the control circuit 152. The control circuit 152 converts the wireless input signal into a control signal and transmits the control signal to the driver circuit 150. The driver circuit 150 receives the control signal and drives the light source module 11 to operate according to the control signal, so that the illuminating device 10 can be easily controlled to turn on or turn off by the remote controller 19. Thus, a remote control of the illuminating device 10 is obtained.

Figure 4:
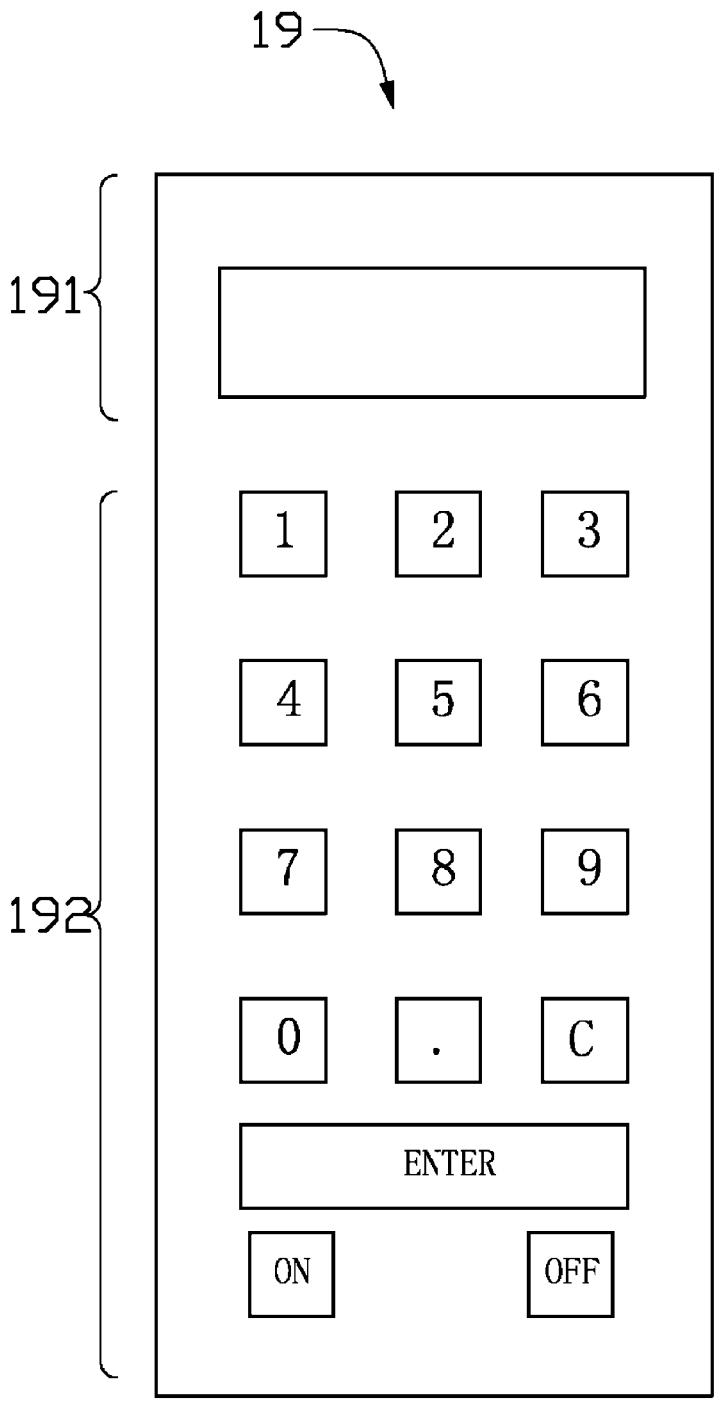
FIG. 4 is a schematic, plan view of a remote controller for the illuminating device of FIG. 3.

Referring to FIG. 4, the remote controller 19 for the illuminating device 10 is shown. The remote controller 19 includes a display section 191 and a keyboard section 192. A plurality of keys, such as number keys, cancel key, ENTER key, ON/OFF keys, are located in the keyboard section 192. The remote controller 19 can input an operating time of the illuminating device 10 via the number keys in the keyboard section 192. The input time is displayed on the display section 191 so as to ensure whether the input time is correct. If the input time is incorrect, it can be cancelled by the cancel key C in the keyboard section 192. If the input time is correct, it can be confirmed by the ENTER key in the keyboard section 192. In addition, the illuminating device 10 can be controlled to turn on by the ON key, or to turn off by the OFF key in the keyboard section 192. Therefore, commands can be inputted into the remote controller 19 by the plurality of keys in the keyboard section 192, and the wireless input signal is accordingly sent from the remote controller 19 to the illuminating device 10.

In the present illuminating device 10, the receiver 151, the control circuit 152 and the driver circuit 150 are provided in the electronic module 15 to enable that the illuminating device 10 can be controlled by the remote controller 19. The illuminating device 10 can be easily controlled to turn on or turn off by the remote controller 19. Thus, the remote control of the illuminating device 10 is obtained. In addition, the wireless input signal can be inputted simply via pressing the keys in the keyboard section 192, which simplifies the operation of the illuminating device 10. Furthermore, the electronic module 15 is detachably engaged with the light source module 11. The electronic module 15 and the light source module 11 can easily be replaced, or repaired.

Figure 5:
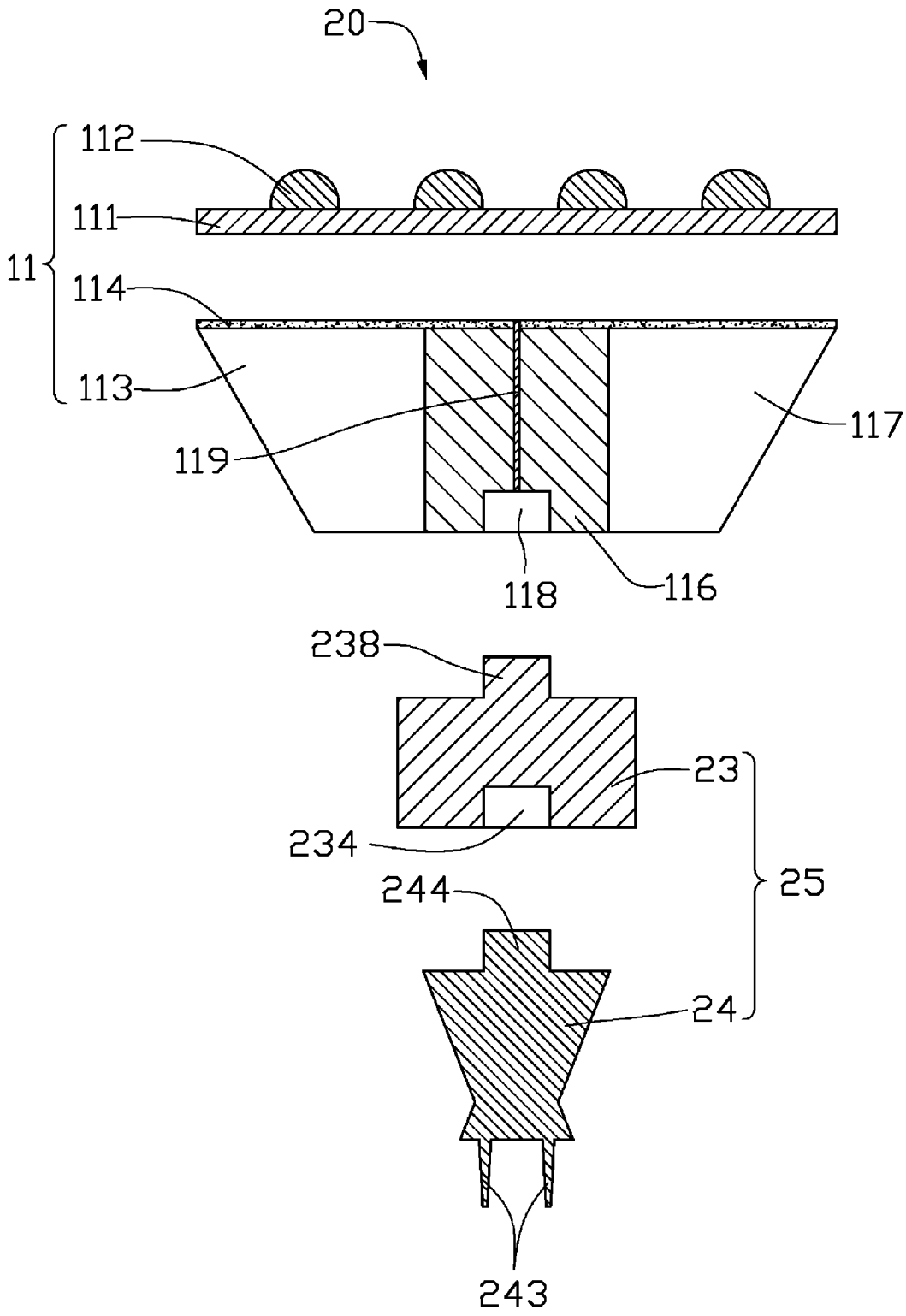
FIG. 5 is an exploded, cross-sectional view of an illuminating device, in accordance with a second embodiment of the present invention.
Figure 6:
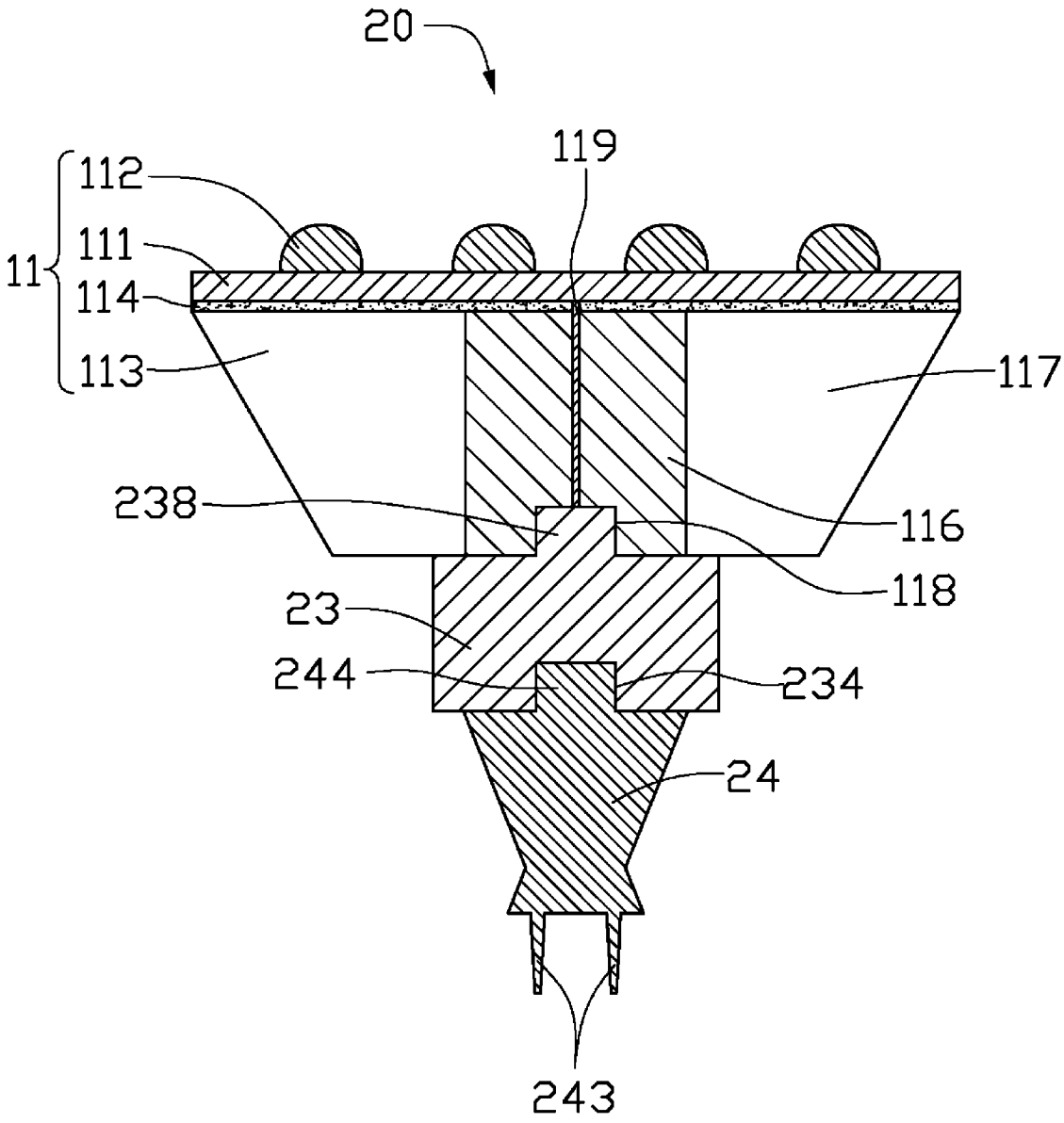
FIG. 6 is an assembled view of the illuminating device of FIG. 5.
Figure 7:
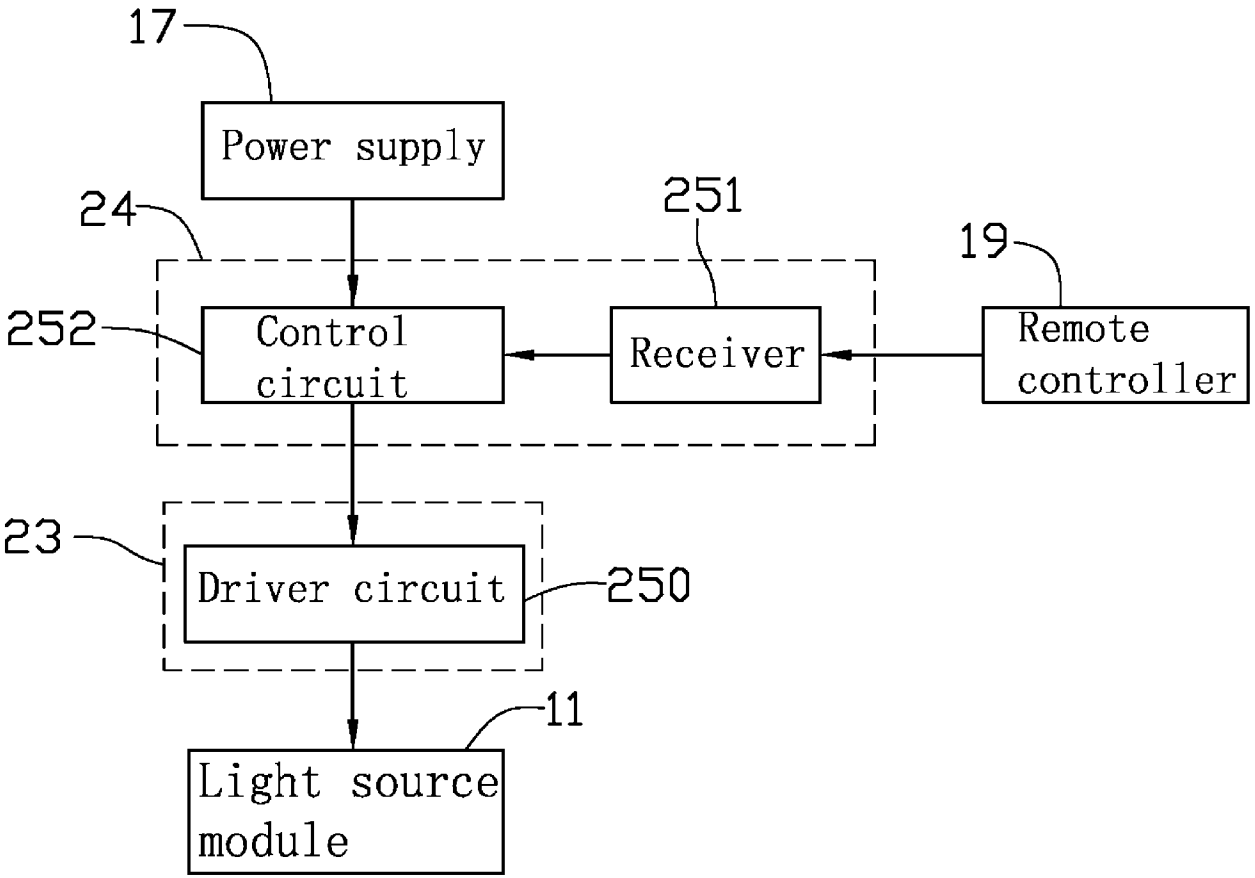
FIG. 7 is a diagram showing a working principle of the illuminating device of FIG. 5.

Referring to FIGS. 5 and 7, an illuminating device 20 in accordance with a second embodiment of the present invention is shown. In this embodiment, the electronic module 15 includes a driving module 23 and a receiver module 24 detachably engaged with the driving module 23. The driver circuit 250 is built in the driving module 23, and the receiver 251 and the control circuit 252 are built in the receiver module 24.

The driving module 23 defines a fixing groove 234 at one end thereof, and forms a driving coupler 238 at the other end thereof. The driving coupler 238 is protruded out from the driving module 23 to engage in the connecting groove 118 of the light source module 11, so as to mechanically connect with the heat sink 113 and electrically connect with the electric wire 119.

The receiver module 24 forms a pair of electrical input connectors 243 and an output coupler 244 at two opposite ends thereof. The output coupler 244 is protruded out from the senor module 24 to engage in the fixing groove 234 of the driving module 23, so as to mechanically and electrically connect with the driving module 23. The input connectors 243 are electrically connected with the power supply 17 which supplies power to the driving module 23, the receiver module 24 and the light source module 11. A working principle of the illuminating device 20 is substantially the same as that of the illuminating device 10 in the first embodiment.

In the present illuminating device 20, the receiver module 24 is detachably engaged with the driving module 23. Therefore, the receiver module 24 and the driving module 23 can easily be replaced, or repaired.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An illuminating device comprising:

a light source module comprising at least one light emitting diode; and an electronic module detachably connected with the light source module, the electronic module comprising a receiver for receiving a wireless control signal from a remote controller, a control circuit electronically coupled to the receiver, and a driver circuit for driving the at least one light emitting diode, the control circuit configured for controlling the driver circuit according to the received control signal;

wherein the electronic module comprises a driving module and a receiver module detachably connected with the driving module, the driver circuit being built in the driving module, the receiver and the control circuit being built in the receiver module;

wherein the light source module comprises a printed circuit board and a heat sink thermally connected with the printed circuit board, the at least one light emitting diode being mounted on the printed circuit board; and wherein the heat sink defines a connecting groove at one end thereof, the driving module forming a driving coupler at one end thereof and defining a fixing groove at the other end thereof, the receiver module forming an electrical input connector and an output coupler at two opposite ends thereof, the driving coupler of the driving module being engaged in the connecting groove of the heat sink, the output coupler of the receiver module being engaged in the fixing groove of the driving module, the electrical input connector of the receiver module being configured for electrical connection with a power supply.

2. The illuminating device as claimed in claim 1, wherein the heat sink comprises a heat conductive post, an electric wire extending through the heat conductive post electrically interconnecting the printed circuit board with the electronic module.

3. The illuminating device as claimed in claim 1, further the remote controller for transmitting the wireless input signal to the receiver, the remote controller including a display section and a keyboard section.

4. A remote controllable illuminating device comprising:

a light source module including a circuit board, at least one light emitting diode on the circuit board and a heat sink thermally connected to the circuit board, the heat sink provided with a first engaging unit thereon; and an electronic module electrically connected with the light source module, the electronic module provided with a second engaging unit thereon, the electronic module detachably being connected with the light source module via the first engaging unit engaging with the second engaging unit, the electronic module comprising a receiver and at least one circuit, the receiver being adapted for receiving a signal from a controller, the at least one circuit for receiving the signal from the receiver and driving the light source module to operate according to the signal;

wherein the electronic module comprises a driving module and a receiver module, the second engaging unit being provided on the driving module, the driving module further being provided with a third engaging unit, the receiver module being provided with a fourth engaging unit, the driving module being detachably connected to the receiver module via the third and fourth engaging units.

5. The remote controllable illuminating device as claimed in claim 4, wherein the at least one circuit comprises a control circuit and a driver circuit, the receiver and the control circuit are built in the receiver module, the driver circuit is built in the driving module, the control circuit for receiving the signal from the receiver and converting the signal into a control signal, the driver circuit for receiving the control signal from the control circuit and driving the light source module to operate according to the control signal.

6. The remote controllable illuminating device as claimed in claim 4 wherein the first engaging unit is a groove defined in a bottom of the heat sink, the second engaging unit is a protrusion formed on a top of the driving module, the third engaging unit is a groove defined in a bottom of the driving module, and the fourth engaging unit is a protrusion formed on a top of the receiver module.

7. An apparatus comprising:

a printed circuit board;

a light emitting diode mounted on the printed circuit board;

a heat sink mounted on an opposite side of the printed circuit board to the light emitting diode;

a controlling module mechanically coupled to the heat sink, the controlling module comprising a receiver for receiving a wireless control signal from a remote controller, a controlling circuit electrically connected to the printed circuit board for controlling the light emitting diode in response to the wireless control signal, and a connector adapted for electrical connection to a power supply;

wherein the heat sink comprises a first engaging portion;

wherein the controlling module comprises a driving module and a receiver module, the driving module comprising a second engaging portion and a third engaging portion, the receiver module comprising a fourth engaging portion; and wherein the first engaging portion is detachably connected to the second engaging portion, and the third engaging portion is detachably connected to the fourth engaging portion.

8. The apparatus as claimed in claim 7, wherein the controlling module comprises a driving circuit electrically connected between the connector and the printed circuit board, for driving the light emitting diode, the controlling circuit configured for controlling the driving circuit to drive the light emitting diode.

9. The apparatus as claimed in claim 7, further comprising a remote controller for transmitting the wireless control signal to the receiver.

10. The apparatus as claimed in claim 7, further comprising the power supply electrically connected with the connector.

11. The apparatus as claimed in claim 8, wherein the receiver and the controlling circuit are built in the receiver module, and the driving circuit is built in the driving module.

12. The apparatus as claimed in claim 7, wherein the first engaging portion is a groove defined in a bottom of the heat sink, the second engaging portion is a protrusion formed on a top of the driving module, the third engaging portion is a groove defined in a bottom of the driving module, and the fourth engaging portion is a protrusion formed on a top of the receiver module.

* * * * *